United States Patent [19]

Murayama et al.

[11] Patent Number: 4,596,521

[45] Date of Patent: Jun. 24, 1986

[54] SCROLL FLUID APPARATUS

[75] Inventors: Akira Murayama; Hiroaki Kuno; Naoshi Uchikawa; Takahiro Tamura; Takao Mizuno; Masao Shiibayashi, all of Shimizu, Japan

[73] Assignee: Hitachi, Ltd., Tokyo, Japan

[21] Appl. No.: 559,088

[22] Filed: Dec. 7, 1983

[30] Foreign Application Priority Data

Dec. 17, 1982 [JP] Japan ..... 57-220068
Dec. 24, 1982 [JP] Japan ..... 57-226071

[51] Int. Cl.[4] ..... F04C 18/04; F04C 29/10

[52] U.S. Cl. ..... 418/55; 418/180; 418/189

[58] Field of Search ..... 418/55, 77, 180, 189

[56] References Cited

U.S. PATENT DOCUMENTS 2,841,089 7/1958 Jones ..... 418/55
4,443,166 4/1984 Ikegawa et al. ..... 418/55

FOREIGN PATENT DOCUMENTS 56-156490 12/1981 Japan ..... 418/55
57-188793 11/1982 Japan ..... 418/55
82/02739 8/1982 PCT Int'l Appl. ..... 418/55

*Primary Examiner*—John J. Vrablik

*Assistant Examiner*—Theodore W. Olds

*Attorney, Agent, or Firm*—Antonelli, Terry & Wands

[57] ABSTRACT

A scroll fluid apparatus including a fixed scroll member and an orbiting scroll member each having an end plate and a wrap, the two scroll members being maintained in meshing engagement with each other with the respective wraps facing inwardly to allow the orbiting scroll member to move in orbiting movement with respect to the fixed scroll member without rotating on its own axis. The fixed scroll member is formed with a discharge port at its central portion and a suction port at its outer peripheral surface to draw a gas by suction through the suction port and allow same to flow in a sealed space defined between the two scroll members and reducing its space during operation to thereby compress the gas and discharge the compressed gas through the discharge port. A clearance is defined between an outer peripheral surface of the end plate of the orbiting scroll member and a wall facing the outer peripheral surface and successively changing its volume as the orbiting scroll member moves in orbiting movement, and at least one pressure relieving space is provided to communicate with the clearance for conveniently discharging a fluid from the clearance to avoid compression of the fluid.

1 Claim, 34 Drawing Figures

SCROLL FLUID APPARATUS

BACKGROUND OF THE INVENTION

This invention relates to scroll fluid apparatus, and more particularly it is concerned with a construction of the scroll fluid apparatus suitable for discharging a lubricant collecting at an outer peripheral portion of an end plate of an orbiting scroll member to reduce a drive force required to operate the apparatus.

In, for example, Japanese Laid Open Pat. No. 73886/82 a sealed type electric compressor in the form of a scroll fluid apparatus is proposed which comprises a compressor section and an electric motor section contained in a sealed container, and a fluid passage extending through a wall of the sealed container and connected through a line to outside equipment which may be an evaporator or condenser of a refrigerating apparatus. The scroll type compressor section comprises a fixed scroll member and an orbiting scroll member in meshing engagement with each other which constitute the essential portions of the compressor. The fixed scroll member and orbiting scroll member each includes an end plate, and a wrap of vortical form located in upright position on the each end plate and having an involute curve or a curve similar to that. A suction port for a fluid is formed in a position in the vicinity of an outer side of a space defined between the two scroll members, and a discharge port opens in a position close to the center of the fixed scroll member. A rotation preventing member in the form of an Oldham's ring is mounted between the orbiting scroll member and a frame or the fixed scroll member to prevent the orbiting scroll member from rotating on its own axis, and a crankshaft is kept in engagement with the orbiting scroll member through a bearing to move the orbiting scroll member in orbiting movement about the center of the fixed scroll member without rotating on its own axis, so as to compress a fluid in the sealed space defined between the two scroll members and discharge the compressed fluid through the discharge port. To compress the fluid and discharge the compressed fluid efficiently as described hereinabove, it is necessary that the orbiting scroll member be forced against the fixed scroll member with a suitable force. The axial biasing force which urges the orbiting scroll member against the fixed scroll member is obtained by the difference between the pressure in compression chambers and the pressure applied to the back of the orbiting scroll member, and the difference in pressure is introduced through a fine communicating port communicating the compression chambers with the back of the orbiting scroll member.

Meanwhile, a lubricant collecting in the sealed container is utilized for cooling the bearings and sliding portions of the compressor section. The lubricant is fed to each bearing through oil ducts formed in the crankshaft by the difference in pressure between an intermediate pressure and a high pressure, and then flows into a back pressure chamber on the back of the orbiting scroll member. The lubricant flowing into the back pressure chamber is discharged therefrom in suitable amount into the compression chambers through the communicating port during operation and entrained in the compressed gas to flow in circulation therewith.

In the scroll fluid apparatus of the aforesaid construction, the lubricant flowing into the back pressure chamber is discharged into the compression chambers through the communicating port formed in the end plate of the orbiting scroll member. However, if the amount of the lubricant fed to the bearings exceeds the discharge capacity of the communicating port, then the back pressure chamber would be filled with the lubricant which would be agitated by a balance weight, causing a loss of power. The lubricant would invade a clearance in an outer peripheral portion of the end plate of the orbiting scroll member, and if such clearance were filled with the lubricant, the lubricant would be compressed by the orbiting movement of the orbiting scroll member, thereby causing an increase in the power necessary for operating the apparatus.

SUMMARY OF THE INVENTION

This invention has as its object the provision of a scroll fluid apparatus capable of avoiding compression of oil in the outer peripheral portion of the end plate of the orbiting scroll member, to thereby prevent an increase in the power necessary for operating the apparatus.

According to the invention, a scroll fluid apparatus is provided which comprises a fixed scroll member including a disc-shaped end plate and a wrap of a vortical form located in upstanding position on the end plate, and an orbiting scroll member including a disc-shaped end plate and a wrap of a vortical form located in upstanding position on the end plate. The two scroll members are maintained in meshing engagement with each other with the respective wraps facing inwardly to allow the orbiting scroll member to move in orbiting movement with respect to the fixed scroll member without rotating on its own axis. The fixed scroll member is formed with a discharge port opening at its central portion and a suction port opening at its outer peripheral surface to draw a gas by suction through the suction port and allow the same to flow in a sealed space defined between the two scroll members and reduce its volume during operation to thereby compress the gas into a compressed gas which is discharged through the discharge port. A clearance is defined between an outer peripheral surface of the end plate of the orbiting scroll member and a wall facing the outer peripheral surface, with the clearance successively changing its volume as the orbiting scroll member moves in orbiting movement. At least one pressure relieving space communicates with the clearance for conveniently effecting fluid discharge from the clearance to avoid compression of the fluid.

The term "fluid discharge" as used in this specification refers not only to the discharge of the fluid into other space, that is, to a space on the lower pressure side or a compression chamber, but also to the flow of the fluid from a small size portion of the clearance to a large size portion thereof. Stated differently, the term "fluid discharge" includes the discharge of a fluid from a clearance space of small size to a clearance space of large size.

What is important in the invention is to discharge a fluid or cause the same to flow as quickly as possible from a smallest size portion of a clearance which successively changes its volume as the orbiting scroll member moves in orbiting movement into other space of large size. To this end, it is most preferable to bring the smallest size portion of the clearance into direct communication with the space of large size.

However, to facilitate the flow of the fluid from the smallest size portion of the clearance, the fluid may be first led to a space corresponding to such space of large size or a large size portion of the clearance created by the orbiting movement of the orbiting scroll member, and then the fluid may be introduced into a compression chamber or a space on the lower pressure side.

Depending upon the condition of operaton, the fluid discharge may be carried out continuously or be effected intermittently, with the intermittent fluid discharge being carried out by opening and closing a duct formed in the fixed scroll member or the end plate of the orbiting scroll member while the orbiting scroll member moves in orbiting movement.

In any case, the provision of the pressure relieving space for quickly reducing the volume of the fluid in a small size portion of the clearance prevents the fluid from being compressed and allows the power necessary for driving the apparatus to be reduced.

DETAILED DESCRIPTION

Figure 1:
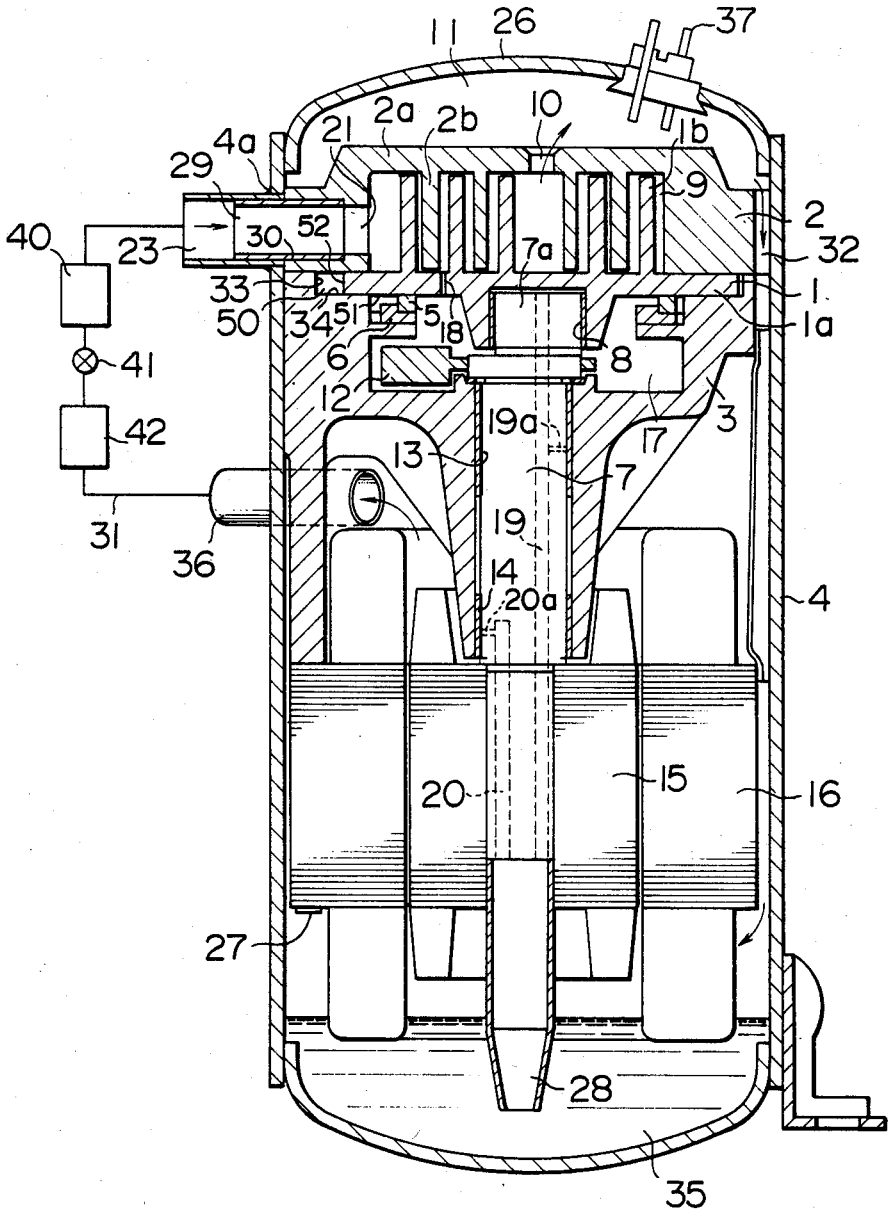
FIG. 1 is a sectional view of a scroll fluid apparatus serving as a sealed type electric compressor.

Referring now to the drawings wherein like reference numerals are used throughout the various views to designate like parts and, more particularly, to FIG. 1, according to this figure, a scroll fluid apparatus includes an orbiting scroll member 1 including a disc-shaped end plate 1*a* and a wrap 1*b* of a vortical form located in upstanding position on the end plate 1*a*, a fixed scroll member 2 including a disc-shaped end plate 2*a* and a wrap 2*b* of a vortical form located in upstanding position on the end plate 2*a*, and a frame 3 constituting a compressor section of a unitary structure wherein the orbiting and fixed scroll members 1 and 2 mesh with each other. The compressor section is fitted in and secured to a cylinder 4 constituting a sealed container. An Oldham's key 5 and an Oldham's ring 6 in sliding engagement with each other are mounted in a back pressure chamber 17 formed at the back of the end plate 1*a* of the orbiting scroll member 1 between the orbiting scroll member 1 and the frame 3. A crankshaft 7 includes an eccentric shaft portion 7*a* which is in engagement with the orbiting scroll member 1 through a swing bearing 8. A sealed space 9 is defined between the end plates 1*a* and 2*a* of the orbiting and fixed scroll members 1 and 2 as the wraps 1*b* and 2*b* thereof mesh with each other. The sealed space 9 includes a plurality of compression chambers 230 (see FIG. 17) which have their volumes successively reduced while being alternately communicated with a discharge port 10 formed in a central portion of the end plate 2*a* of the fixed scroll member 2. The discharge port 10 opens in a space 11 defined by a chamber plate 26 constituting a part of the sealed container. A balance weight 12 is fixed to the crankshaft 7 which is journalled by an upper main bearing 13 and a lower main bearing 14. The crankshaft 7 supports, at an end portion thereof a rotor 15 of a motor whose stator 16 is secured to the frame 3 by bolts 27. A communicating port 18 is formed in the end plate 1*a* of the orbiting scroll member 1 to maintain communication between the sealed space 9 and the back pressure chamber 17. An oil duct 19, extending through the crankshaft 7, has one opening in an oil feeding section 28 at a lower end portion of the crankshaft 7 and the other opening in an end face of the eccentric shaft portion 7*a*. The oil duct 19 is maintained in communication with the upper main bearing 13 through an oil passage 19*a*. Another oil duct 20 has one end opening in the oil feeding section 28 at the lower end portion of the crankshaft 7 and the other end opening in the lower main bearing 14 through another oil passage 20*a*. A suction pipe 23, extending through a wall of the cylinder 4 has one end connected to equipment on a lower pressure side, such as for example, an evaporator, and the other inserted in a hole 30 formed in a wall of the fixed scroll member 2. The suction pipe 23 is joined by welding as indicated at 4*a* to the cylinder 4. A tubular passage 29 is inserted in the hole 30 and fixed thereto to communicate with a suction port 21 communicated with the lower pressure side of the sealed space 9. The cylinder 4 forming the sealed container has a lubricant 35 collected at a bottom portion thereof, with a discharge pipe 36 extending through the wall of the cylinder 4, and a terminal 37 for connection to a power source is mounted on a cap of the chamber plate 26. An evaporator 40, an expansion valve 41 and a condenser 42 are connected with the compressor section of the aforesaid construction to form the refrigeration cycle.

In operation, when the scroll compressor is driven for operation, the orbiting scroll member 1 is driven by a motor through the crankshaft 7 to move in orbiting movement, to draw a gas from the evaporator 40 on the lower pressure side through the suction pipe 23 into the sealed space 9 by suction. The gas is compressed into a compressed gas of high temperature and pressure which is discharged through the discharge port 10 into the space 11 in the chamber plate 26. The compressed gas which contains oil flows through a passage 32 to a chamber where the motor is contained.

The motor is higher in temperature than the compressed gas because it generates heat as a result of its rotation, so that the motor is cooled when brought into contact with the gas. The oil entrained in the gas is separated from the gas when the gas is brought into contact with the motor and other parts and collects in an oil sump at the bottom of the sealed container while the gas having the majority of the entrained gas separated therefrom flows through the discharge pipe 36 into the condenser 42 where it is subjected to heat exchange with, for example, outdoor air and changes to a liquid state by giving off heat. The fluid in the liquid state is expanded by having its pressure reduced by the expansion valve 41 into a gas of low temperature and pressure which flows into the evaporator 40 where it cools, for example, air by its cooling action. After performing the cooling action, the gas is drawn by suction again through the suction pipe 23 into the scroll compressor, to be compressed again.

Meanwhile, the lubricant 35 is drawn from the oil feeding section 28 by the difference in pressure between the high pressure inside the sealed container produced by the operation of the compressor and the intermediate pressure prevailing in the back pressure chamber 17 and fed through the oil ducts 19 and 20 and the oil passages 19*a* and 20*a* into the upper and lower main bearings 13 and 14 and the swing bearing 8 to lubricate same. After lubricating the bearings, the oil collects in the back pressure chamber 17 and is led therefrom through the communicating port 18 communicating the back pressure chamber 17 with the sealed space 9 to the sealed space 9 where it is compressed together with the gas.

Figure 1A:
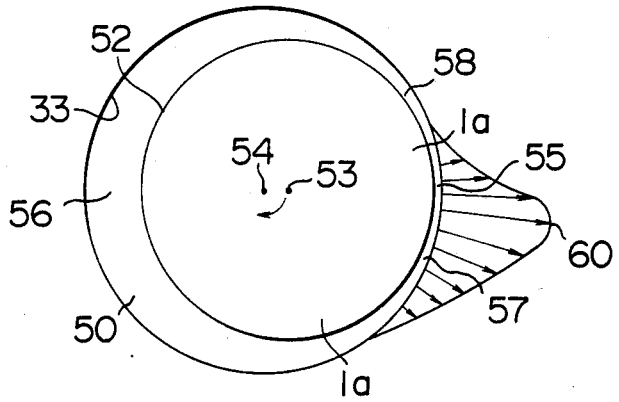
FIG. 1*a* is a view of a clearance formed by the orbiting movement of the orbiting scroll member, showing a rise in the pressure of a fluid in the clearance as the fluid is compressed by the orbiting movement.

During the aforesaid operation, the lubricant collecting in the back pressure chamber 17 seeps through a small gap between an under-surface 51 of the end plate 1*a* of the orbiting scroll member 1 and a bottom surface 34 of the frame 3 into a clearance 50 between an outer peripheral surface 52 of the end plate 1*a* of the orbiting scroll member 1 and an wall 33 of the frame 3 facing each other (see FIG. 1*a*). The intermediate pressure of the gas and oil in the back pressure chamber 17 is applied to the undersurface 51 of the end plate 1*a* to force the same against the end plate 2*a* of the fixed scroll member 2. Thus, the undersurface 51 tends to move away from the bottom surface 34, but the gap therebetween is restricted to a very small value even if they separate themselves from each other.

As shown in FIG. 1*a*, the clearance 50 successively changes its shape between the wall 33 of the frame 3 and the outer peripheral surface 52 of the end plate 1*a* of the orbiting movement. The end plate 1*a* of the orbiting scroll member 1 has a center 53 which revolves in orbiting movement in the direction of an arrow in the figure about a center 54 of the frame 3. When the end plate 1*a* of the orbiting scroll member 1 moves to a rightmost position in FIG. 1*a*, the clearance 50 has a minimum size in the vicinity of a point 55 and a maximum size in the vicinity of a point 56 disposed in a position diametrically opposed to that of the point 55. As the orbiting scroll member 1 moves in orbiting movement, the clearance 50 gradually becomes smaller in size at a point 57 disposed posterior to the point 55 with respect to the direction of orbiting movement of the scroll member 1 and larger in size at a point 58 disposed anterior to the point 55 with respect to the direction of orbiting movement of the scroll member 1. Thus, if the oil flows into the clearance 50, then it is compressed in the vicinity of the point 57 in which the clearance 50 becomes smaller in size with the orbiting movement of the orbiting scroll member 1 and rises in pressure to a higher level than in the vicinity of other points. This phenomenon is marked in a portion of the clearance 50 posterior to the point 55 of minimum size and the pressure in such portion rises to a maximum level as indicated at 60, so that a force is produced which acts in a direction opposite to the direction of the orbiting movement of the orbiting scroll member 1. Enabling the orbiting scroll member 1 to move in orbiting movement by overcoming this reverse-acting force would require an additional drive force to be exerted in the orbiting scroll member 1.

Figure 2:
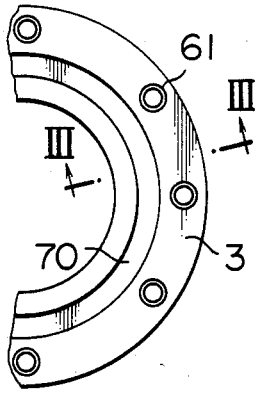
FIG. 2 is a fragmentary plan view of the frame formed with a peripheral groove along the entire outer periphery thereof.
Figure 3:
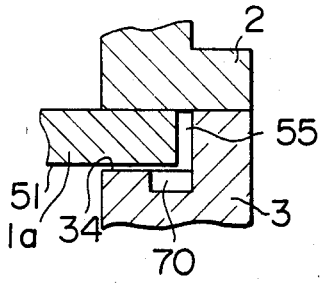
FIG. 3 is a cross-sectional view taken along the line III—III in FIG. 2.

Thus, by releasing the oil from the minimum size portion of the clearance 50 as quickly as possible, it is possible to avoid the oil being compressed and thus to eliminate the need to use an additional drive force. FIGS. 2 and 3 show means provided by the invention for discharging as quickly as possible the oil from the vicinity of the minimum size point 55 of the clearance 50 to a space of larger volume. The frame 3 is formed with an annular groove 70 at the bottom surface 34 thereof, so that the oil in the vicinity of the minimum size point 55 flows through the groove 70 to the vicinity of the maximum size point 56, thereby avoiding the oil being compressed in the vicinity of the minimum size point 55. The groove 70 and other clear space of larger volume function as a pressure relieving space for avoiding compression of the fluid.

In FIG. 3, a considerably large gap is shown as being defined between the undersurface 51 of the end plate 1*a* of the orbiting scroll member 1 and the bottom surface 34 of the frame 3. However, in actual practice, such gap is very small. The gap shown in FIG. 3 is exaggerated to enable the action of the intermediate pressure in the back pressure chamber 17 to force the end plate 1*a* of the orbiting scroll member 1 against the end plate 2*a* of the fixed scroll member to be better understood. Bolt holes 61 enables inserting bolts for securing of the fixed scroll member 2 to the frame 3.

Figure 4:
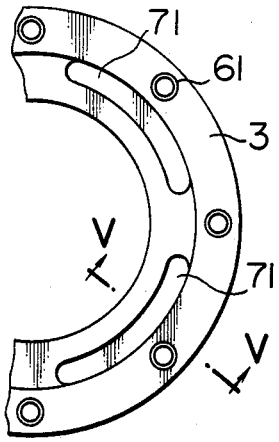
FIG. 4 is a fragmentary plan view of the frame formed with a plurality of peripheral grooves located discretely along its outer periphry.
Figure 5:
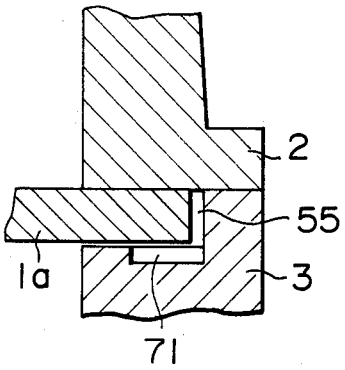
FIG. 5 is a cross-sectional view taken along the line V—V in FIG. 4.

As shown in FIGS. 4 and 5 means for discharging the oil from the vicinity of the minimum size point 55 may comprise a plurality of peripheral grooves 71 located discretely at the bottom surface 34 of the frame 3 in place of the annular groove 70 shown in FIGS. 2 and 3. The discrete peripheral grooves 71 perform the same function as the annular groove 70.

Figure 6:
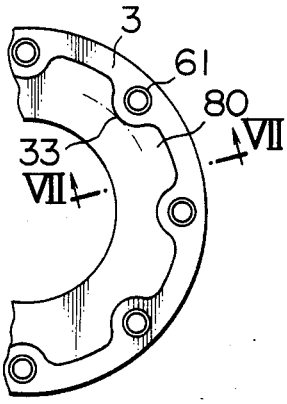
FIG. 6 is a fragmentary plan view of the frame formed with a plurality of recesses discretely located along its outer periphery.
Figure 7:
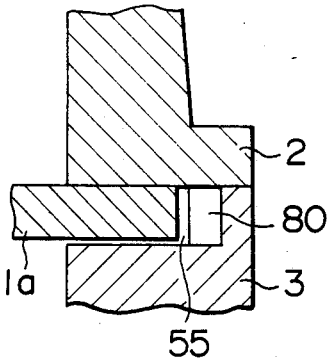
FIG. 7 is a cross-sectional view taken along the line VII—VII in FIG. 6.

As shown in FIGS. 6 and 7, to dischange the oil from the vicinity of the minimum size point 55, it is also possible to provide a plurality of recesses 80 located discretely along the wall 33 of the frame 33 and constituting pressure relieving spaces maintained in communication with the vicinity of the minimum size point 55. The provision of the discrete recesses 80 can achieve the effect of relieving the pressure.

Figure 8:
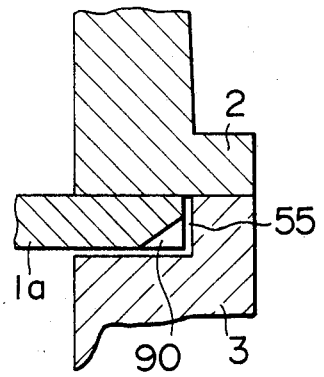
FIG. 8 is a sectional view of the end plate of the orbiting scroll member having a cutout.

In FIG. 8, a cutout 90 is formed at a corner of the end plate 1*a* of the orbiting scroll member 1 between its undersurface 51 and its outer peripheral surface 52 and extending along the entire circumference of the end plate 1*a*.

Figure 9:
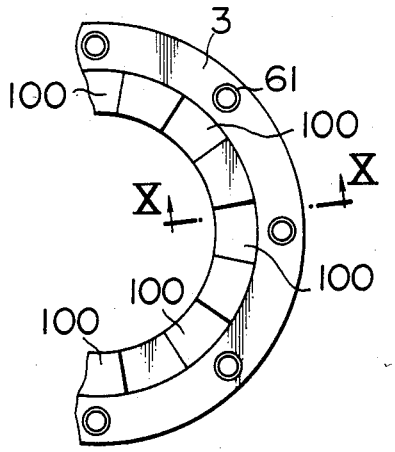
FIG. 9 is a fragmentary plan view of the frame formed with a plurality of grooves at its outer periphery.
Figure 10:
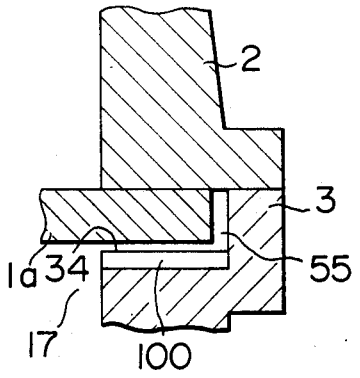
FIG. 10 is a cross-sectional view taken along the line X—X in FIG. 9.

In order to enable a discharging of the compressed fluid into the back pressure chamber 17, as shown in FIGS. 9 and 10, a plurality of radial grooves 100 may be formed at the bottom surface 34 of the frame 3 and maintained in communication with the back pressure chamber 17 serving as a pressure relieving space. As the end plate 1*a* moves close to the vicinity of the minimum size point 55 near the wall 33 of the frame 3, the oil flows through the grooves 100 to the back pressure chamber 17.

Figure 11:
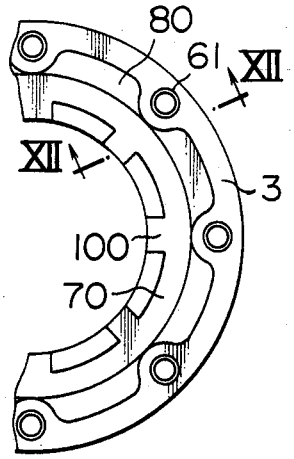
FIG. 11 is a fragmentary plan view of the frame formed with a plurality of recesses disposed discretely along its outer periphery, a groove extending along the entire outer periphery and a plurality of radial grooves.
Figure 12:
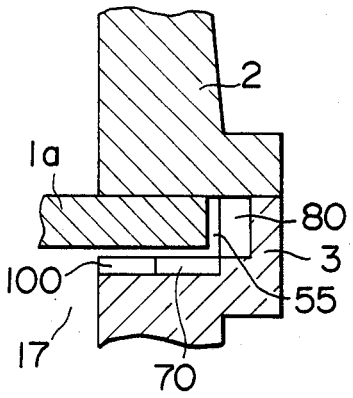
FIG. 12 is a cross-sectional view taken along the line XII—XII in FIG. 11.
Figure 13:
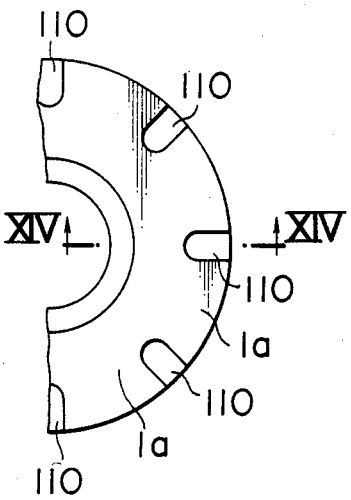
FIG. 13 is a fragmentary plan view of the back of the end plate of the orbiting scroll member formed with a plurality of grooves.
Figure 14:
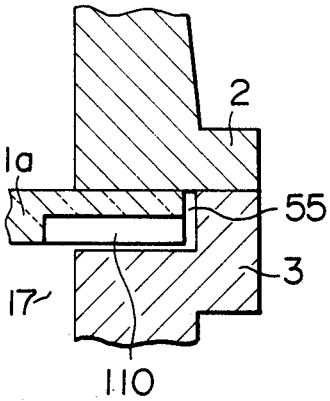
FIG. 14 is a cross-sectional view taken along the line XIV—XIV in FIG. 13.
Figure 15:
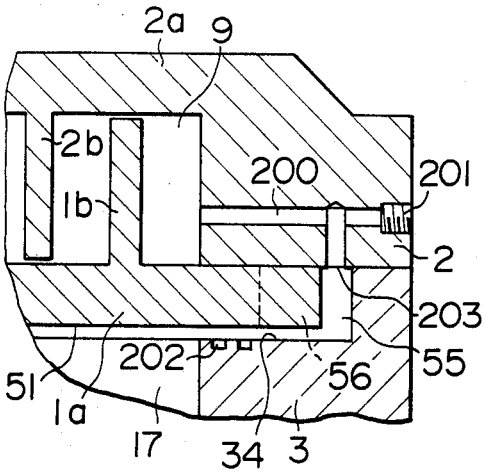
FIG. 15 is a fragmentary sectional view of the fixed scroll member formed with a duct for communicating the clearance with the low pressure space.

FIGS. 11 and 12 provide an illustration of a combination of the annular groove 70 shown in FIGS. 2 and 3 and the recesses 80 shown in FIGS. 6 and 7, with FIGS. 13 and 14 showing a plurality of grooves 110 located at the undersurface 51 of the end plate 1*a* of the orbiting scroll member 1 for discharging the oil into the back pressure chamber 17. As shown in FIG. 15, a communicating duct 200 is formed in the fixed scroll member 2 and with one end of the communicating duct 200 opening in the vicinity of the minimum size point 55 or maximum size point 56 of the clearance 50 and the other end opening in the sealed space 9 which is a lower pressure space. A plug 201 seals the communicating duct 200, and a labyrinth 202 is provided for forming a seal between the undersurface 51 of the end plate 1*a* of the orbiting scroll 1 and the bottom surface 34 of the frame 3 to avoid the oil being discharged in excess into a lower pressure section. The communicating duct 200 opens at 203 in the clearance 50 and successively brings all the points from the minimum size point 55 to the maximum size point 56 in the clearance 50 which changes its shape as the orbiting scroll member 1 moves in orbiting movement into communication with the sealed space 9.

Figure 16:
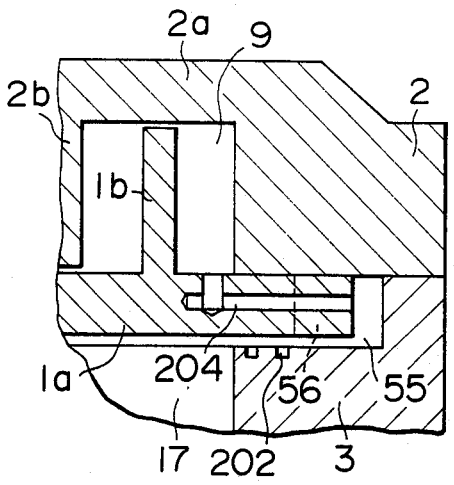
FIG. 16 is a fragmentary sectional view of the end plate of the orbiting scroll member formed with a duct for communicating the clearance with the low pressure space.

FIG. 16 shows a communicating duct 204 formed in the end plate 1*a* of the orbiting scroll member 1. In this constructional form, it is unnecessary to close those ducts with plugs after being formed.

Figure 17:
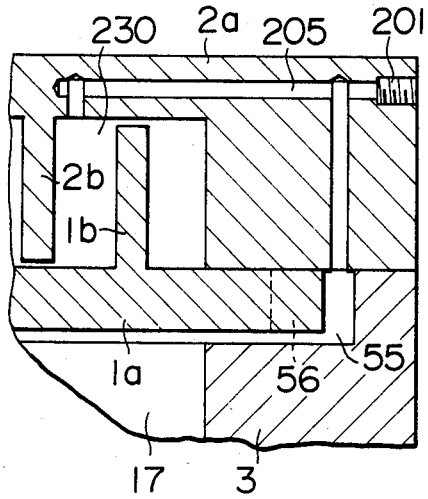
FIG. 17 is a fragmentary sectional view of the fixed scroll member formed with a duct for communicating the clearance with the compression chamber.
Figure 18:
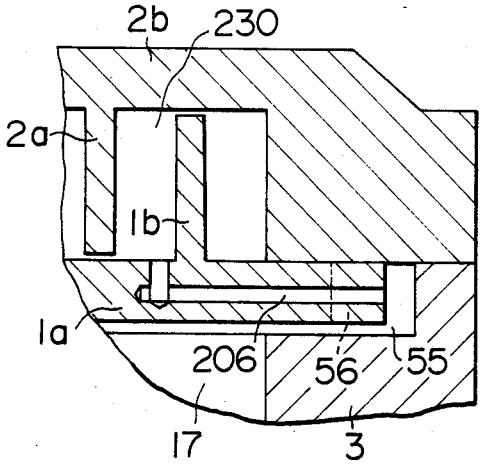
FIG. 18 is a fragmentary sectional view of the orbiting scroll member formed at its end plate with a duct for communicating the clearance with the compression chamber.

In FIG. 17, a communicating duct 205 is shown as extending through the end plate 2*a* of the fixed scroll member 2 and communicating with a compression chamber 230. This constructional form offers the advantage that a reduction in volume efficiency can be avoided because the fluid is discharged into the fluid being compressed. FIG. 18 shows a communicating duct 206 formed in the end plate 1*a* of the orbiting scroll member 1 and communicating with the compression chamber 230. This constructional form eliminates the need to insert plugs in ducts.

In the constructional forms shown in FIGS. 17 and 18 in which the fluid is discharged into the compression chamber 230, the need to provide a labyrinth for avoiding the discharge of oil in excess can be eliminated, thereby simplifying the construction.

Figure 19:
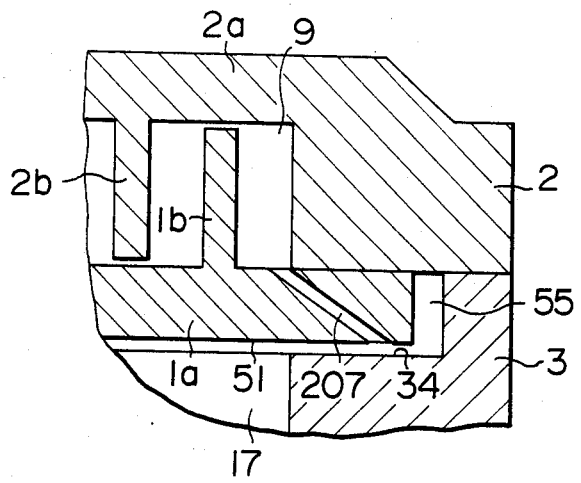
FIG. 19 is a fragmentary sectional view of the orbiting scroll member formed at its end plate with an inclined duct for communicating a gap between the back of the end plate and the bottom surface of the frame.

In FIG. 19, an inclined communicating duct 207 extends through the end plate 1*a* of the orbiting scroll member 1 and opens at one end at an interface between the undersurface 51 of the end plate 1*a* and the bottom surface 34 of the frame 3 and at an opposite end in the sealed space 9 which is a lower pressure space. In this constructional form, the open one end of the communicating duct 207 is closed as the end plate 1*a* of the orbiting scroll member 1 is brought out of contact with the end plate 2*a* of the fixed scroll member 2 and the undersurface 51 thereof is brought into contact with the bottom surface 34 of the frame 3, so that the discharge of oil stops and the volume of discharged oil can be controlled.

Figure 20:
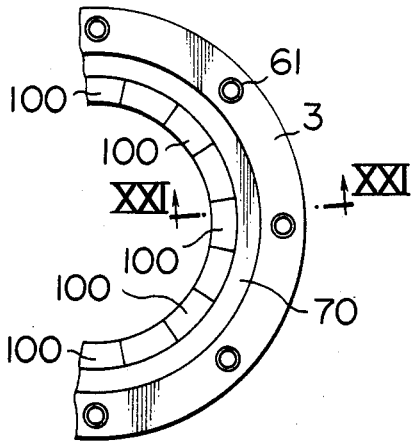
FIG. 20 is a fragmentary plan view of the frame formed with the grooves shown in FIGS. 2 and 9.
Figure 21:
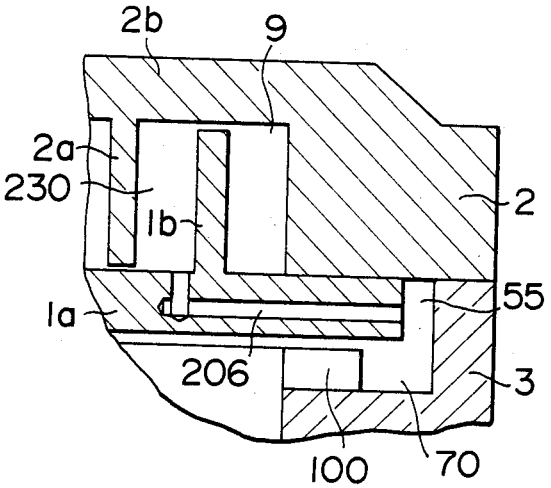
FIG. 21 is a fragmentary cross sectional view taken along the line XXI—XXI in FIG. 20, showing the end plate of the orbiting scroll member formed with the duct shown in FIG. 18.

FIGS. 20 and 21 show a constructional form which has the highest practical value and which constitutes a combination of the constructional forms shown in FIGS. 2, 9 and 18. It has been ascertained that the constructional form shown in FIGS. 20 and 21 enables the scroll type compressor to operate with a minimum input of power for driving same.

In the constructional forms described hereinabove, the oil in the clearance 50 is discharged therefrom or made to flow therein in a constant volume at all times during operation.

Constructional forms presently to be described are those in which the discharge of the oil takes place intermittently or is drastically restricted. By drastically restricting the discharge of the oil, it is possible to avoid the excessive discharge of the oil from the clearance 50.

Figure 22:
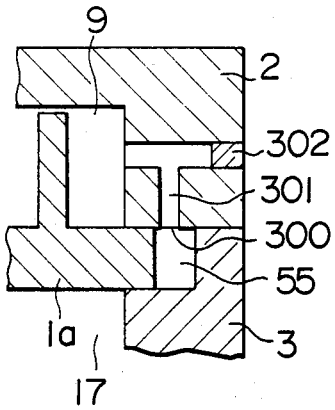
FIG. 22 is a fragmentary sectional view of the fixed scroll member, showing a duct communicated with the clearance which may be opened and closed intermittently.
Figure 23:
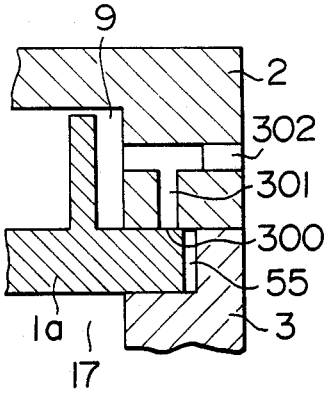
FIG. 23 is a view similar to FIG. 22 but showing the duct in the closed position.
Figure 24:
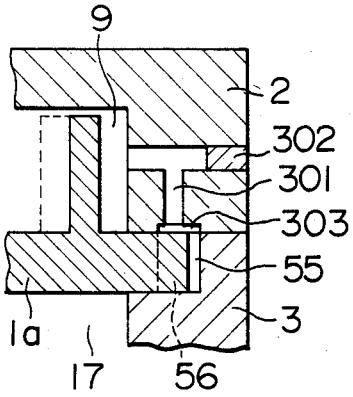
FIG. 24 is a fragmentary sectional view of the fixed scroll member, showing another constructional form of the duct shown in FIG. 22.
Figure 25:
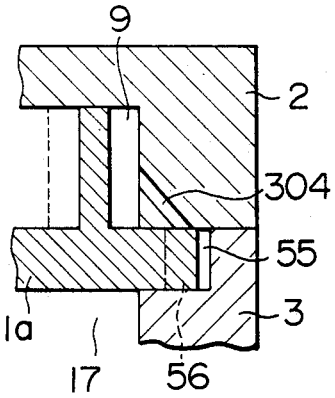
FIG. 25 is a fragmentary sectional view of the fixed scroll member, showing another constructional form of the duct shown in FIG. 22, i.e. in a slanting position.
Figure 26:
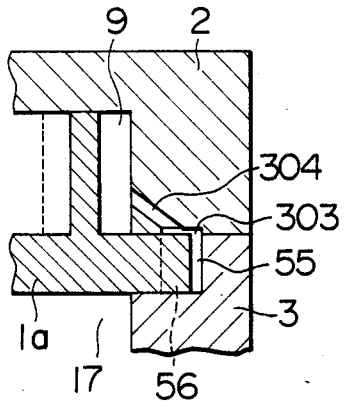
FIG. 26 is a fragmentary sectional view of the fixed scroll member, showing a modification of the duct shown in FIG. 24.
Figure 27:
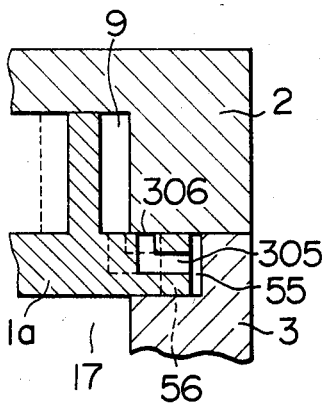
FIG. 27 is a fragmentary sectional view of the orbiting scroll member formed at its end plate with a duct intermittently communicated with the clearance.
Figure 28:
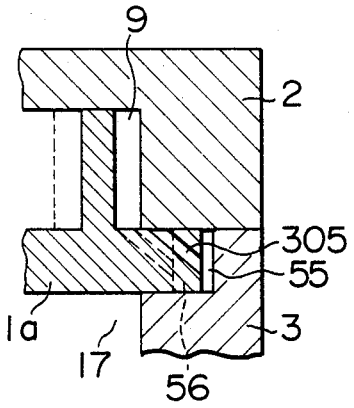
FIG. 28 is a view similar to FIG. 27 but showing the duct intermittently communicated with the clearance in a slanting position.

In FIGS. 22 and 23, a communicating duct 301 is formed in the fixed scroll member 1 which has an end 300 opened and closed by the end plate 1*a* of the orbiting scroll member 1 as it moves in orbiting movement and communicates at its opposite end with the sealed space 9 which is a lower pressure space. In FIG. 22, the end 300 is shown as communicating with the clearance 50 in the vicinity of the maximum size point 56; and in FIG. 23, the end 300 is shown as being closed by the end plate 1*a* because it is disposed in the vicinity of the minimum size point 55 of the clearance 50. By bringing the end 300 of the communicating duct 301 cyclically to the two positions shown in FIGS. 22 and 23, it is possible to intermittently discharge the oil from the clearance 50 into a space on the lower pressure side. A plug 302 is provided for closing an end of the communicating duct 301. In FIG. 24, the communicating duct 301 opens in a recess 303 formed at the fixed scroll member 2 which has an opening of substantialy the same area as the vicinity of the maximum size point 56 of the clearance 50. Thus, as the end plate 1*a* of the orbiting scroll member 1 moves rightwardly in the figure, the opening of the recess 303 is reduced in area and, consequently, the passage through the duct 301 is reduced in area, to thereby restrict the volume of the oil discharged from the clearance 50. As means for intermittently discharging the oil from the clearance 50, an inclined communicating duct 304 may be provided as shown in FIG. 25 which can achieve the end with less time and labor for fabrication than the constructional forms shown in FIGS. 22 and 23. In FIG. 26, a combination of the inclined communicating duct 304 shown in FIG. 25 with the recess 303 shown in FIG. 24 is shown. In FIG. 27, a communicating duct 305 is shown as being formed in the end plate 1*a* of the orbiting scroll member 1 and having an opening 306 which is brought into and out of communication with the sealed space 9 which is a lower pressure section by the undersurface of the fixed scroll member 2. By this constructional form, it is possible to control the volume of the oil discharged from the clearance 50 by allowing the oil to be intermittently discharged. The duct 305 shown in FIG. 27 may be inclined as shown in FIG. 28 which facilitate fabrication because duct formation can be performed in one step.

Figure 29:
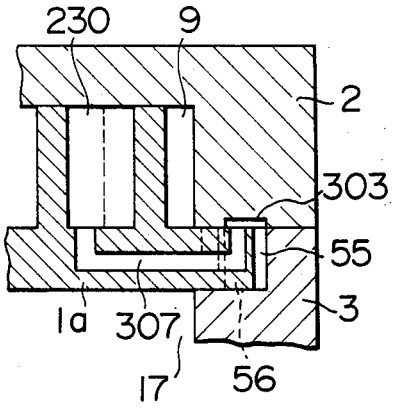
FIG. 29 is a fragmentary sectional view of the fixed scroll member formed with a duct communicating the clearance with the compression chamber.
Figure 30:
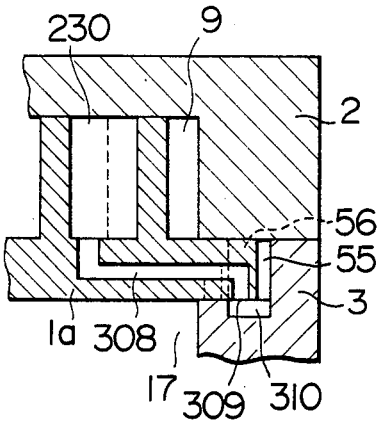
FIG. 30 is a fragmentary sectional view of the frame formed with a duct communicating the compression chamber with a groove formed on the bottom surface of the frame.
Figure 31:
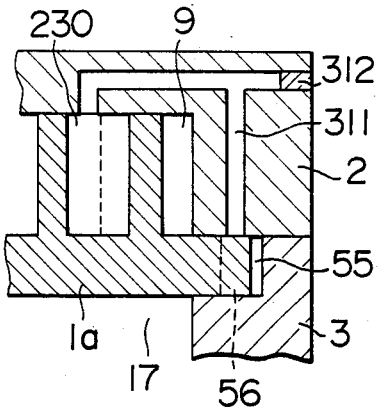
FIG. 31 is a fragmentary sectional view of the frame formed with a duct intermittently communicated with the compression chamber.
Figure 32:
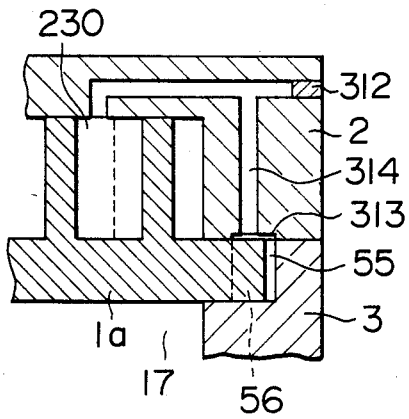
FIG. 32 is a view similar to FIG. 31 but showing another constructional form of the duct.
Figure 33:
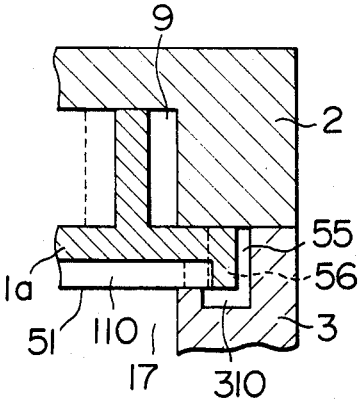
FIG. 33 is a fragmentary sectional view of the frame and the orbiting scroll member, showing the end plate of the orbiting scroll member formed at its back with a groove communicating with the groove formed on the bottom surface of the frame.

In constructional forms shown in FIGS. 29, 30, 31 and 32, the oil is discharged from the clearance 50 into the compression chamber 230. In FIG. 29, a communicating duct 307 is formed in the end plate 1*a* of the orbiting scroll member 1 and the recess 303 alternately communicating with the minimum and maximum size points 55 and 56 is formed at the fixed scroll member 2, so that the area of the opening of the recess 303 can be varied by the orbiting movement of the orbiting scroll member 1 to effect control of the volume of the oil discharged from the clearance 50. In FIG. 30, a communicating duct 308 having an opening 309, is formed in the end plate 1*a* of the orbiting scroll member 1 and communicates alternately with the minimum and maximum size points 55 and 56 of the clearance 50 through a groove 310 formed at the bottom surface of the frame 3. By this arrangement, the opening 309 is opened and closed as the orbiting scroll member 1 moves in orbiting movement. In FIG. 31, a communicating duct 311 is formed in the fixed scroll member 1. A plug 812 is provided for sealing an end of the duct 311. In FIG. 32, a communicating duct 314 is formed in the fixed scroll member 2 and maintained alternately in communication with the minimum and maximum size points 55 and 56 through a recess 313 formed at the fixed scroll member 2. In this constructional form, it is possible to increase and decrease the area of the oil passage to control the volume of the oil discharged from the clearance 50 without completely blocking the passage of oil through the opening of the recess 313. FIG. 33 shows a constructional form in which a groove 110 is formed at the undersurface 51 of the end plate 1*a* of the orbiting scroll member 1 and maintained in communication with the groove 310 formed at the bottom surface of the frame 3. In this constructional form, the area of an opening maintaining the grooves 110 and 310 in communication with each other undergoes a change as the orbiting scroll member 1 moves in orbiting movement, to thereby enable control of the volume of the oil discharged into the back pressure chamber 17 to be effected.

From the foregoing description, it will be appreciated that the invention enables a fluid to flow in and be discharged from the clearance to a space of large volume by virtue of the aforesaid means for discharging oil from the clearance 50 defined betwen the wall 33 of the frame 3 and the outer peripheral surface 52 of the end plate 1*a* of the orbiting scroll member 1. This is conducive to a prevention of an increase in the power necessary for operating the scroll type compressor which would otherwise be caused by the compression of the oil.

What is claimed is:

1. A scroll fluid apparatus comprising a fixed scroll member including a disc-shaped end plate and a wrap of a vortical form located in an upstanding position on the end plate, an orbiting scroll member including a disc-shaped end plate and a wrap of vortical form located in an upstanding position on the end plate, said two scroll members being maintained in meshing engagement with each other with the respective wraps facing inwardly to allow the orbiting scroll member to move in orbiting movement with respect to the fixed scroll member without rotating on its own axis, said fixed scroll member being formed with a discharge port at its central portion and a suction port opening at its outer peripheral surface to draw a gas by suction through the suction port and allow the same to flow in a sealed space defined between the two scroll members and reducing its volume during operation the thereby compress the gas into a pressed gas which is discharged through the discharge port;

a clearance defined between an outer peripheral surface of the end plate of the orbiting scroll member and a wall facing said outer peripheral surface and successively changing its volume as the orbiting scroll member moves in orbiting movement; and at least one pressure relieving space commuicating with said clearance for conveniently effecting fluid discharged from the clearance to avoid compression of the fluid, said pressure relieving space comprising a first groove extending along the entire periphery of a bottom surface of a frame supporting said end plate of the oribiting scroll member juxtaposed against an undersurface of said end plate for communication with said clearance, a plurality of second grooves located radially at the bottom surface of the frame and communicating with said first groove, a communicating duct formed in said end plate of the orbiting scroll member and communicating with said clearance, and a compression chamber space connected to said communicating duct.

* * * * *